United States Patent [19]

Yun et al.

[11] Patent Number: 4,685,489

[45] Date of Patent: Aug. 11, 1987

[54] VALVE ASSEMBLY AND COMPRESSOR MODULATION APPARATUS

[75] Inventors: Kyung W. Yun, Troy; Othel L. Jones; Gerald M. Long; John P. Elson, both of Sidney, all of Ohio

[73] Assignee: Copeland Corporation, Sidney, Ohio

[21] Appl. No.: 714,011

[22] Filed: Mar. 22, 1985

Related U.S. Application Data

[63] Continuation-in-part of Ser. No. 599,770, Apr. 13, 1984, abandoned.

[51] Int. Cl.[4] ..... F16K 15/02; F04B 49/00

[52] U.S. Cl. ..... 137/543.15; 417/274; 417/440; 92/60.5

[58] Field of Search ..... 137/543.15, 516.15, 137/516.17, 516.19, 516.21, 516.23; 417/296, 274–277, 440; 92/13.6, 60.5

[56] References Cited

U.S. PATENT DOCUMENTS

| | | | |
|---|---|---|---|
| 1,154,798 | 9/1915 | Palmer | 417/279 X |
| 1,222,579 | 4/1917 | Pratt | 137/543.15 |
| 1,327,564 | 1/1920 | McDougall | 137/543.15 X |
| 1,839,403 | 1/1932 | MacFadden | 137/543.15 |
| 2,170,846 | 8/1939 | Bach | 417/275 |
| 2,261,911 | 11/1941 | Condit | 417/275 |
| 2,726,032 | 12/1955 | Cooper et al. | 417/440 X |
| 2,799,562 | 7/1957 | Bresler | 417/275 X |
| 2,833,462 | 5/1958 | Scheerer | 92/60.5 |
| 3,209,985 | 10/1965 | Sahle | 417/296 |
| 3,354,790 | 11/1967 | Race | 92/60.5 |
| 3,882,759 | 5/1975 | Formwalt et al. | 92/13.6 X |
| 3,887,160 | 6/1975 | Cusueller | 92/13.6 X |
| 3,972,652 | 8/1976 | Minnicino | 417/277 |
| 4,249,458 | 2/1981 | Massing | 92/13.6 X |
| 4,340,085 | 7/1982 | Crawford et al. | 137/543.15 X |
| 4,368,755 | 1/1983 | King | 417/567 X |
| 4,408,629 | 10/1983 | Lafont | 137/543.15 X |
| 4,445,824 | 5/1984 | Bunn et al. | 417/440 |

FOREIGN PATENT DOCUMENTS

| | | | |
|---|---|---|---|
| 859713 | 12/1952 | Fed. Rep. of Germany | 417/274 |
| 1247138 | 8/1967 | Fed. Rep. of Germany | 92/13.6 |

*Primary Examiner*—Alan Cohan
*Assistant Examiner*—John Rivell
*Attorney, Agent, or Firm*—Harness, Dickey & Pierce

[57] ABSTRACT

A method and several embodiments of apparatus are disclosed for modulating the capacity of a gas compressor. A discharge valve member is formed with an opening therein and fluid communication between the compression chamber and a clearance pocket is selectively established by a slidable plunger element. In a first position, the plunger fills the opening in the discharge valve member to close fluid communication between the clearance pocket and the compression chamber. In a second position, the plunger element moves away from the valve member to establish fluid communication between the compression chamber and the clearance pocket, wherein the reexpansion volume is increased and the capacity of the compressor reduced. In the preferred embodiment, an apertured neck member is provided. The valve member is slidably guided by outer walls of the neck member, and the plunger has a stem designed to slidingly fit within the neck aperture. Also, several embodiments of an improved valve assembly are disclosed which can be employed in a gas compressor with or without a capacity modulation system.

64 Claims, 13 Drawing Figures

Fig-3
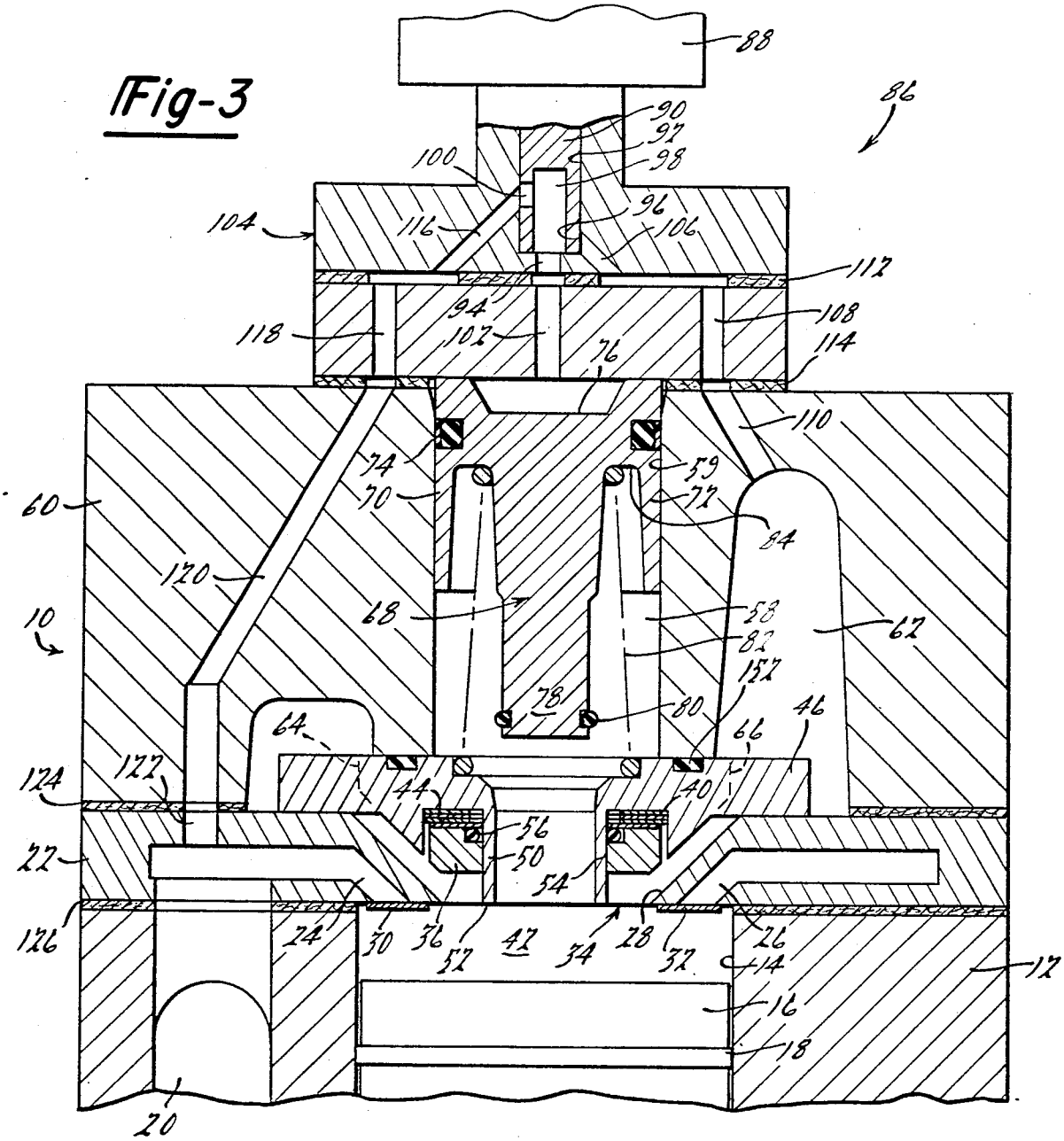
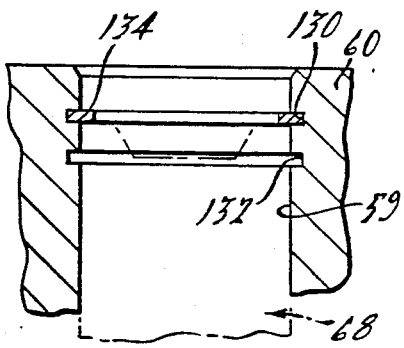
Fig-4
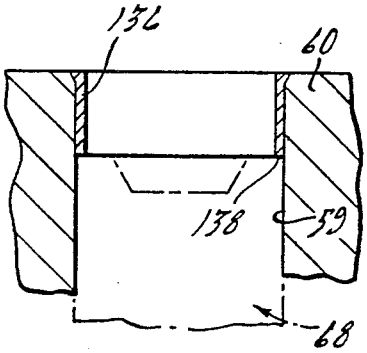
Fig-5
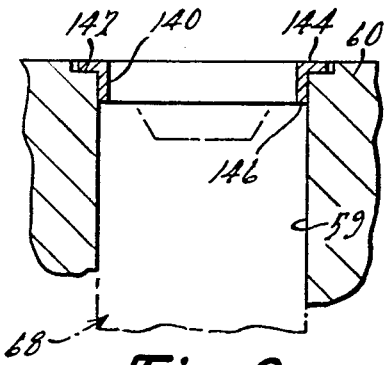
Fig-6

VALVE ASSEMBLY AND COMPRESSOR MODULATION APPARATUS

This is a Continuation-In-Part of copending application Ser. No. 599,770, filed Apr. 13, 1984, now abandoned by Kyung W. Yun and Othel L. Jones, and entitled "Compressor with Capacity Modulation", and which was assigned to Copeland Corporation, the same assignee as the present invention. The disclosure of said copending application is hereby incorporated herein by reference.

BACKGROUND AND SUMMARY OF THE INVENTION

The invention relates generally to improved fluid valve assemblies, and more particularly to such valve assemblies for gas compressors. The invention also relates to a capacity modulation apparatus for such compressors. The invention is applicable, however, to such compressor valve assemblies, both with or without such a capacity modulation system.

Reciprocating piston-type gas compressors typically include pressure-actuated suction and discharge valving mounted generally at the end of the cylinder between the head assembly and the compression chamber. It is critical to the overall operation of a gas compressor to provide a sufficiently large port area to permit the flow of a maximum volume of gas within a given time period, at an acceptably small pressure drop. This is particularly true for refrigeration compressors employed in air conditioning systems because of the relatively high mass flow rates generally required in such systems. In addition to maximizing the port area for a given cylinder size, it is advantageous to reduce the weight of a moving valve member and thereby limit the inertia effect thereof, as well as to minimize the operating noise of the valve assembly, especially in high speed compressors.

In such gas compressors, it is also important to normally minimize the reexpansion or clearance volume at the valve end of the cylinder. Accordingly, the valving and the compression chamber end wall should have a shape that is complimentary with that of the top of the piston, to enable the piston to reduce the volume of the compression chamber to a minimum during the compression stroke without restricting gas flow. While it may be possible to accomplish this objective by designing a complex piston head shape, manufacturing of such complex pistons is very expensive, assembly is difficult and throttling losses frequently occur as the piston approaches top dead center. Such reduction of reexpansion volume is also of great importance in refrigeration compressors having relatively low mass flow rates, such as those employed in very low temperature refrigeration systems, as well as in heat pump applications.

Because of the criteria discussed above, the present invention seeks to provide an improved valve and valve seat combination for use as a discharge valve in gas compressors, without regard to whether or not means are provided for capacity modulation. The invention thus seeks to improve the efficiency of the gas compressor, the discharge flow characteristics at all valve lifts, the sealing characteristics of the valve without permanent deformation of the valve member, the durability of the valve assembly, the quietness and smoothness of operation, and the valve assembly's ability to operate in high speed compressors.

In many refrigeration (and heat pump) systems some type of technique is required to control or modulate the capacity of gas compressors. The need for compressor capacity modulation arises from the dilemma of a constant displacement pump being coupled to a system with varying heating and cooling demands wherein the refrigeration system functions to balance the load of heat influx at a selected temperature at the evaporator. This load will vary from minimum to maximum levels for which the system was designed.

Normally, load balance in gas compressors is accomplished with a thermal expansion valve which regulates the flow of liquid phase refrigerant in to the evaporator. If the heat load in a refrigeration systems decreases, the expansion valve reduces the refrigerant flow rate. Conversely, the expansion valve increases refrigerant flow when the heat load increases. Thus, if the system has no means for capacity control, a reduction in refrigerant flow rate will result in a lowering of suction pressure. The compressor capacity is therefore reduced as it operates at a higher compression ratio and a lower volumetric efficiency. To some extent, this reduction can be tolerated and is usually taken into consideration in the system design. However, there is a minimum suction temperature or pressure below which either the compressor or the system should not be operated, which may be the saturated suction temperature at which frost begins to form on an air-cooling evaporator coil, or perhaps the minimum temperature limitations of a water chiller.

In some cases, particularly in low temperature refrigeration systems, a compressor may overheat as the compression ratio becomes excessive with reduced flow rates. Smaller refrigeration systems can use a simplistic approach, employing a thermostat or suction pressure operated switch to start and stop the compressor to overcome these problems. In larger refrigeration systems, however, this approach is not desirable because of the resultant wide temperature fluctuations and the adverse effects on compression reliability. Therefore, in such large refrigeration systems, a sensor is used to selectively activate an unloader mechanism for modulating the capacity of the compressor without shutting it down.

Several different types of unloaders have been used in the past, including hot gas bypass unloaders, blocked suction unloaders, suction valve lifter mechanisms, and reexpansion clearance pockets. The present invention is particularly applicable to this latter type of unloader in which clearance pockets are used to provide an additional clearance or reexpansion volume, with the clearance pocket being separated from the cylinder by a stop valve or the like, in order to thereby reduce the volumetric efficiency of the compressor.

Previous designs of capacity modulation systems using clearance pockets have several drawbacks. Frequently, the hardware is bulky and impractical to use with modern, high speed compressors where compactness is an important design objective. Alternatively some previous designs rely upon manual adjustments to valves or pistons to define the additional clearance volume. While these prior art approaches may have been manageable for a relatively few slow speed compressors, the manual adjustment approach is not practical in modern day air conditioning or refrigeration systems where automatic control is desired. In addition, such previous designs have not lent themselves to be incorporated into compressors utilizing the "Discus" valving construction developed by Copeland Corporation, the assignee of the present invention. This valving arrangement is characterized by its improved flow characteristics at all valve lifts, good sealing without permanent deformation of the valve, long life, quietness in operation, and its ability to operate in high speed compressors. More details of this valve assembly can be found in U.S. Pat. No. 4,368,755 issued to King on Jan. 18, 1983, which patent is assigned to Copeland Corporation, the assignee of the present invention, and is hereby incorporated herein by reference.

Pursuant to the present invention as it applies to a capacity modulation system, a valve member for a gas compressor is formed with an opening therethrough, and a head assembly connected to the valve plate includes a clearance pocket therein. A plunger element slidably mounted in the clearance pocket is provided with a base or stem extending into an open cylindrical neck member disposed in the valve member opening. The plunger is adapted to move to a first position which closes off fluid communication between the compression chamber and the clearance pocket and thereby places the compressor in a fully loaded condition. In a second position, the plunger retracts away from the opening in the valve member to allow fluid communication between the compression chamber and the clearance pocket in order to unload the compressor.

Among the advantages of this invention is that a compact design is achieved by making the discharge valving assembly an integral part of the capacity modulation mechanism for defining the extent of the clearance volume. The mass of the discharge valve is reduced thereby reducing impact on the valve seat when the valve is closed. In the preferred embodiment, a retainer member is provided with an apertured neck that serves as a guide for the valve during valve movement and during seating on the valve seat. In addition, a sealing means is provided between the valve member and the neck member in order to sealingly and slidably dispose the valve member on the neck and to provide a dampening effect to reduce valve impact.

In one particular embodiment, a solenoid is used to quickly move the plunger to its loaded or unloaded position. Thus, capacity control is achieved automatically and without the necessity for manual adjustments. In another embodiment of the invention, inserts or sleeves of varying dimensions can be replaceably inserted into the clearance pocket to selectively determine the extent of plunger retraction, thereby defining the volume of the clearance pocket to permit various degrees of desired unloading.

The present invention is further directed toward the provision of an inexpensive and simple, high-efficiency valve apparatus for a modulated gas compressor, or other fluid flow device, wherein the advantageous features of the valve assembly described in the above-mentioned U.S. Pat. No. 4,368,755 can be fully realized. Therefore, the present invention further seeks to improve the operation of the compressor discharge valve assembly, and in particular to reduce the friction between the valve member and the neck member discussed above, thereby increasing its speed and smoothness of operation, while providing good sealing characteristics between the valve member and the neck member, even in high-temperature conditions that frequently occur.

According to the present invention in its broader aspects (i.e., without regard to capacity modulation), an improved valve assembly includes a valve member that is longitudinally movable between closed and open positions, with the valve member having an inner opening extending longitudinally therethrough for receiving a fixed neck member in order to allow guided slidable movement of the valve member on the neck member between an open valve position and a closed valve position. The valve member also includes a shoulder having a sealing surface thereon, with the sealing surface being positioned laterally outboard of the inner opening.

The above-mentioned neck member also includes a shoulder portion having a sealing surface, with a resilient sealing member sealingly engaging both the sealing surface of the valve member and the sealing surface of the neck member when the valve member is in the closed position in order to prevent leakage of gas between the valve member and the fixed neck member. The sealing member is resiliently deflectable during the slidable movement of the valve member between its open and closed positions, and the sealing member does not slidably engage the neck member. The sealing member is biased into such sealing engagement by a gas pressure differential existing across the valve member when in its closed position, as well as by a resilient biasing spring compressed between the sealing member and a fixed portion of the valve assembly.

In one preferred embodiment of the invention, the above-described valve assembly is employed as a discharge valve assembly for a reciprocating piston gas compressor, although it is fully applicable to non-reciprocating type compressors. In such embodiment, the valve assembly includes a valve plate having a valve seat opening extending therethrough with the valve member sealingly engaging the valve seat opening when in its closed position. Preferably the valve member and the neck member have generally flat longitudinally-facing surfaces on opposite sides from their respective shoulder portions, with such generally flat surfaces being substantially coplanar both with one another and with the inner surface of the valve plate when the valve member is in its closed position. These coplanar surfaces in part define a portion of the compression chamber and minimize undesirable reexpansion volume in the compression chamber when capacity modulation is either not provided or not being used.

Additional objects, advantages and features of the present invention will become apparent from the following description and appended claims, taken in conjunction with the accompanying drawings.

BRIEF DESCRIPTION OF THE DRAWINGS

FIG. 3 is a cross-sectional view, similar to that of FIG. 2, but showing the compressor in an unloaded condition.

FIGS. 4 through 6 are fragmentary cross-sectional views, illustrating several embodiments of insert designs for varying the reexpansion volume in the clearance pocket of the capacity modulation apparatus.

DETAILED DESCRIPTION OF THE PREFERRED EMBODIMENTS

Figure 1:
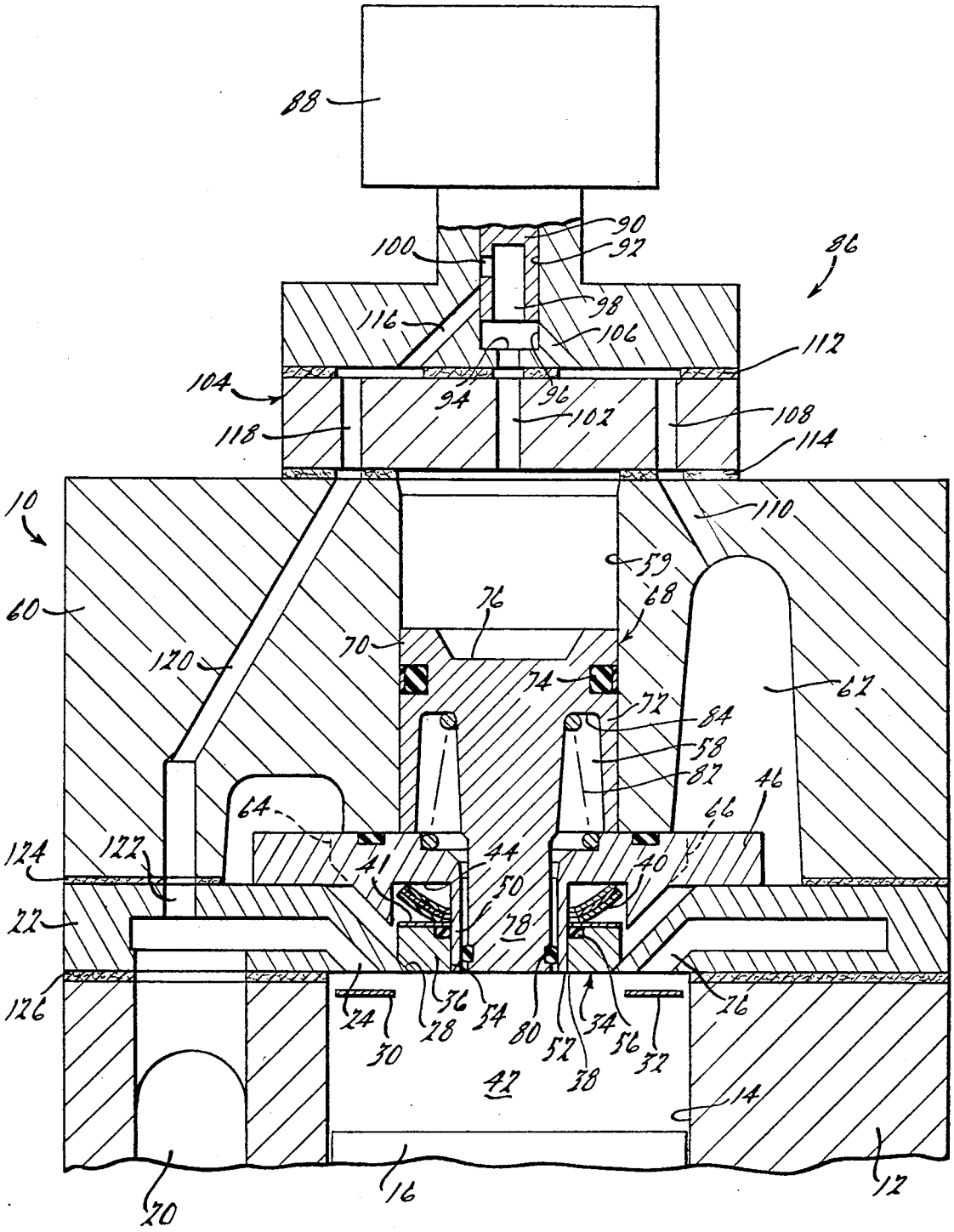
FIG. 1 is a cross-sectional view of a reciprocating gas compressor apparatus including a capacity unloading mechanism in accordance with the present invention, with the gas compressor in a loaded condition during the intake or suction stroke.

FIGS. 1 through 13 illustrate exemplary embodiments of the valve assembly of the present invention in gas compressors, both with and without the provision of a compressor capacity modulation apparatus. As will become apparent from the following discussion, however, the valve assembly of the present invention is equally applicable to other fluid flow devices, as well as to compressor or heat pump devices other than those shown in the drawings.

Figure 2:
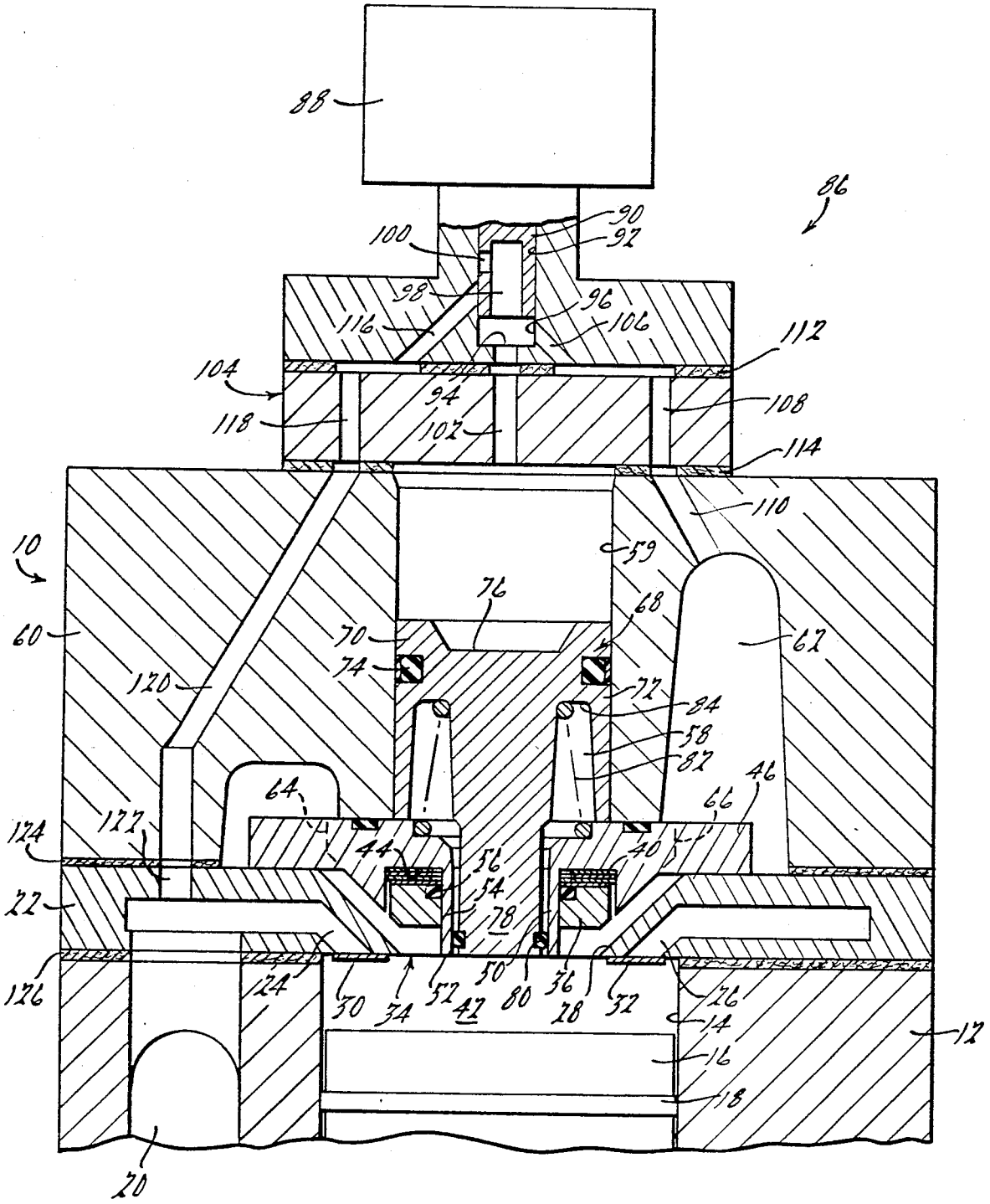
FIG. 2 is a cross-sectional view, similar to that of FIG. 1, but showing the gas compressor during a compression stroke.

Referring now to FIGS. 1 through 3, an unloader mechanism, generally designated by the numeral 10 is shown in conjunction with a reciprocating gas compressor. Cylinder block or compressor body 12 defines a cylinder bore 14 therein for receipt of reciprocating piston 16 having conventional sealing rings 18, and a suction plenum 20 is formed in compressor body 12 adjacent cylinder bore 14. As is known in the art, suction plenum 20 is connected in fluid communication with the intake gas to be compressed, which normally comes from the evaporator in a refrigeration system.

A valve plate 22 has a plurality of suction passages 24 and 26 communicating with suction plenum 20. Central portions of valve plate 22 define an annular valve seat 28 having outwardly diverging side walls which also form part of a discharge passage. A conventional reed type suction valve member is provided with portions 30 and 32 disposed in overlying valving relationship with the interconnected suction passages 24 and 26, respectively.

A discharge port designated by the numeral 34 extends through valve plate 22 and is defined by the inner portions of the side walls of valve seat 28. A pressure responsive valve member 36 is disposed within the discharge port 34, with lower side portions 38 of the valve member 36 being generally frusto-conical in shape and sealingly engaging the valve seat side walls 28. Valve member 36 is urged by suction pressure into sealing engagement with valve seat 28 during the intake stroke of piston 16 and is biased toward such sealing engagement by spring crimps 40 acting on a protector shim 41. During the compression stroke, as shown in FIG. 2, valve 36 raises upwardly to open discharge port 34, after the biasing force of spring crimps 40 is overcome, thereby allowing the gas to be discharged from the compression chamber 42.

Upper portions of the spring crimps 40, which are of a shape that is generally partially cylindrical in shape, (see copending application Ser. No. 580,779, filed Feb. 21, 1984, entitled "Discharge Valve Assembly," and assigned to the same assignee as the present invention, the disclosure of which is herein incorporated by reference), extend into a recess 44 formed in the lower surface of a retainer member 46. The retainer member 46 is provided with a centrally located annular neck portion 50 having an aperture extending therethrough. The end 52 of neck 50 extends downwardly so that its lower surface is substantially coplanar with the lower surface of valve plate 22 and valve member 36 when the valve is closed. Inner surface regions of valve member 36 define a centrally located opening 54 extending therethrough. Neck 50 and the opening 54 in valve member 36 are dimensioned for sliding engagement therebetween, with seal 56 providing a sliding seal between the adjacent surfaces in one embodiment of the invention.

A clearance pocket 58 is defined in part by a bore 59 formed integrally as part of a preferably cast head 60. Head 60 is suitably clamped to compressor body 12, sandwiching valve plate 22 therebetween such that the clearance pocket 58 is arranged coaxially with cylinder bore 14. A discharge plenum 62 surrounding clearance pocket 58 is also formed in head 60 and communicates with the discharge passageways via grooves, passages, or the like, which are formed in retainer 46 as diagrammatically illustrated at 64 and 66.

A plunger element 68 is slidably mounted in the clearance pocket bore 59 and has generally T-shaped arms 70, 72 sealingly engaging inner walls of clearance pocket bore 59 by way of seal 74, which seals between the clearance pocket 58 and the space above plunger 68. A seal 152 (see FIG. 3) is provided between the discharge plenum 62 and the clearance pocket 58. Plunger 68 is provided with a depending base or stem 78 dimensioned so as to fit within the confines of the valve member opening 54 and close off fluid communication therethrough when the plunger 68 is in the position shown in FIGS. 1 and 2. In the preferred embodiment, stem 78 is designed to sealingly engage the inner walls of opening in neck portion 50 when in this position, with a seal 80 being provided therebetween. A coil spring 82 has lower portions thereof abutting retainer 46 and upper portions thereof received in recess 84 formed in plunger 68. The top portion of plunger 68 can optionally be relieved at 76 for purposes of providing a sufficient projected area for exposure to discharge pressure when the compressor is switched from the unloaded mode to the loaded mode, with the discharge pressure acting on the top of plunger 68 being sufficient to overcome the force of spring 82 and the gas pressure acting beneath plunger 68.

Actuator means are provided for moving plunger element 68 quickly between a first position shown in FIGS. 1 and 2, wherein the compressor is fully loaded, and a second position shown in FIG. 3, wherein the compressor is unloaded. In the preferred embodiment, the actuator comprises a solenoid valve assembly 86, including a conventional electrically energizable solenoid coil 88 having a shaft 90 movable to one of two positions depending upon whether the coil 88 is energized or de-energized. Shaft 90 is slidably mounted in a bore 92 having an outlet 94 and an inlet 96 formed in lower portions thereof, and shaft 90 includes a hollowed-out portion 98 in its lower surface and an inlet 100 in one side thereof.

A plurality of fluid communication channels are provided for selectively connecting the volume above plunger 68 with either suction pressure or discharge pressure. One channel is provided by a passageway 102 in cover plate 104 extending between outlet 94 and the top of clearance pocket bore 59 in head 60. As shown in FIGS. 2 and 3, passageway 102 can be connected to discharge plenum 62 by way of passageways 106 and 108 formed in plate 104 and passageway 110 formed in heat 60. Suitable sealing gaskets 112 and 114, or the like, are conventionally used at the interfaces between the various components. Passageway 116 is provided in the solenoid valve body, and passageway 118 is provided in cover plate 104, for communication with suction plenum 20 by way of passageway 120 in head 60 and passageway 122 in valve plate 22. Again, sealing gaskets 124 and 126 are conventionally employed at the interfaces.

The operation of the unloader 10 will now be described. When solenoid coil 88 is energized, shaft 90 is lifted to the position shown in FIGS. 1 and 2, which causes a mismatch between outlet 100 and gas passageway 116 connected to suction pressure. Thus, discharge pressure is introduced by way of passageways 110, 108, 106 and 102 to the space in clearance pocket bore 59 above plunger 68. The discharge pressure acting on plunger 68 exceeds the combined force of the pressure developed in compression chamber 42 and the upward force caused by spring 82 acting on plunger stem 78. Thus, the plunger 68 is maintained in its downward position with the stem 78 and seal 80 closing off fluid communication between compression chamber 42 and clearance pocket 58. Consequently, the reexpansion volume of the compression chamber 42 remains unaffected, and the compressor operates in a fully loaded mode.

When it is desired to unload the compressor, solenoid coil 88 is de-energized, causing solenoid shaft 90 to move downwardly to the position shown in FIG. 3. With solenoid shaft 90 in this position, discharge pressure is blocked, while suction pressure is instead introduced, in the area above plunger 68, because the outlet 100 now matches with the passageway 116. As a result, the force of spring 82 (when combined with the gas pressure acting on the entire lower surface of plunger 68) is sufficient to force the plunger 68 upwardly to establish fluid communication between clearance pocket 58 and the compression chamber 42 through neck 50 in retainer 46. The capacity of the compressor is thereby reduced because of the increased reexpansion volume of the clearance pocket 58.

The amount of unloading can be easily adjusted or modified by way of suitable inserts that restrict the degree of retracting of plunger 68. Several different embodiments of such inserts are shown in FIGS. 4 through 6. In FIG. 4, the wall defining the clearance pocket bore 59 is provided with a plurality of grooves 130 and 132 which are spaced at different axial or longitudinal locations therein. A snap ring 134 can be inserted into one of the grooves to serve as a stop limiting the upward travel of plunger 68. As a result, the volume defined by the clearance pocket 58 is reduced, thereby unloading the compressor to a lesser extent than if the plunger 68 was allowed to travel fully to its uppermost position in clearance pocket 58. In the embodiment of FIG. 5, this is alternately accomplished by way of a sleeve in the form of a spring ring 136 inserted within the clearance pocket bore 59. The depth of the wall 138 of the spring ring 136 is chosen to provide the desired stop position for plunger 68. Alternatively, a flanged ring 140 can be used as shown in FIG. 6. In this embodiment, the top portion of head 60 is provided with a countersunk ledge 142 for receiving the outwardly flared flange 144 of ring 140. Again, the depth of the wall 146 determines the extent of travel of plunger 68. The inserts in each of these embodiments can be easily installed by disconnecting the cover plate 104, placing the insert within the clearance pocket bore, and reconnecting the cover plate.

Those skilled in the art will now appreciate that the present invention provides significant advantages over known constructions of modulating systems in the prior art. Since the unloader operates as an integral part of the valving arrangement for the compressor, a compact design is obtained which limits the overall outline dimension of the compressor apparatus, thereby conserving space. Additionally, the plunger 68 is moved to either of its two positions very quickly under automatic control of the solenoid assembly 86, and the unloader thus easily adapts itself to an automatic control environment in which rapid capacity modulation is an integral part of an entire refrigeration system wherein pressure, temperature, and other parameters are monitored and used as decision criteria for unloading the compressor.

The valve member 36 is of a reduced mass since it includes the opening 54 therein, through which fluid communication between the clearance pocket 58 and compression chamber 42 can be established. This reduced mass lessens the valve impact on the seat 28 when the valve is closed. Another advantageous feature is provided in the preferred embodiment, wherein the retainer neck 50 acts as a guidepost for piloting the valve member 36, as shown in FIG. 2, wherein the valve member 36 is in an open position to allow the compressed gas to be discharged into the discharge plenum 62. It can be seen that the valve member 36 slidably rides up and down on neck 50 thereby maintaining its proper orientation. During the intake stroke of piston 16 (FIG. 1), the neck 50 also helps to insure that the valve member seats properly on valve seat 28.

The simplicity of the mechanism for loading or unloading the compressor provides highly reliable operation requiring no manual adjustment. It is contemplated that one solenoid coil 88 can be used to control either single cylinder or multicylinder compressors, thereby further reducing manufacturing costs. Alternatively a multicylinder compressor can be equipped with a separate solenoid coil and unloading mechanism for each cylinder.

While the above-described embodiments of the present invention provide distinct advantages in terms of compressor capacity modulation and valve operation, it has been discovered that the above-described valve assembly also gives improved speed, efficiency, and reliability, at a reduced cost, in an unmodulated compressor. Such an improved valve assembly is illustrated in the various embodiments of the invention shown in FIGS. 7 through 13.

Figure 7:
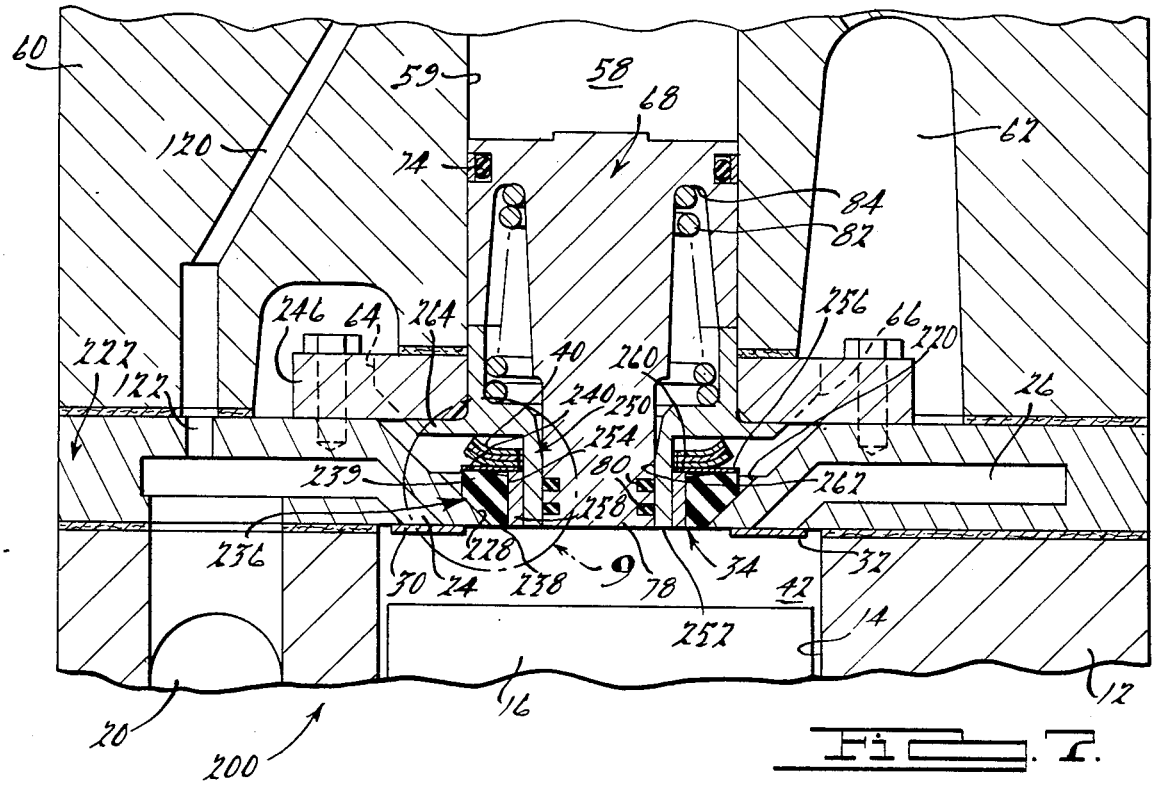
FIG. 7 is a partial cross-sectional view similar to that of FIG. 1, but illustrating a preferred embodiment of a valve assembly incorporating the principles of the present invention disposed in a gas compressor having the capacity modulation apparatus shown in FIG. 1 and operating in a fully loaded condition.
Figure 8:
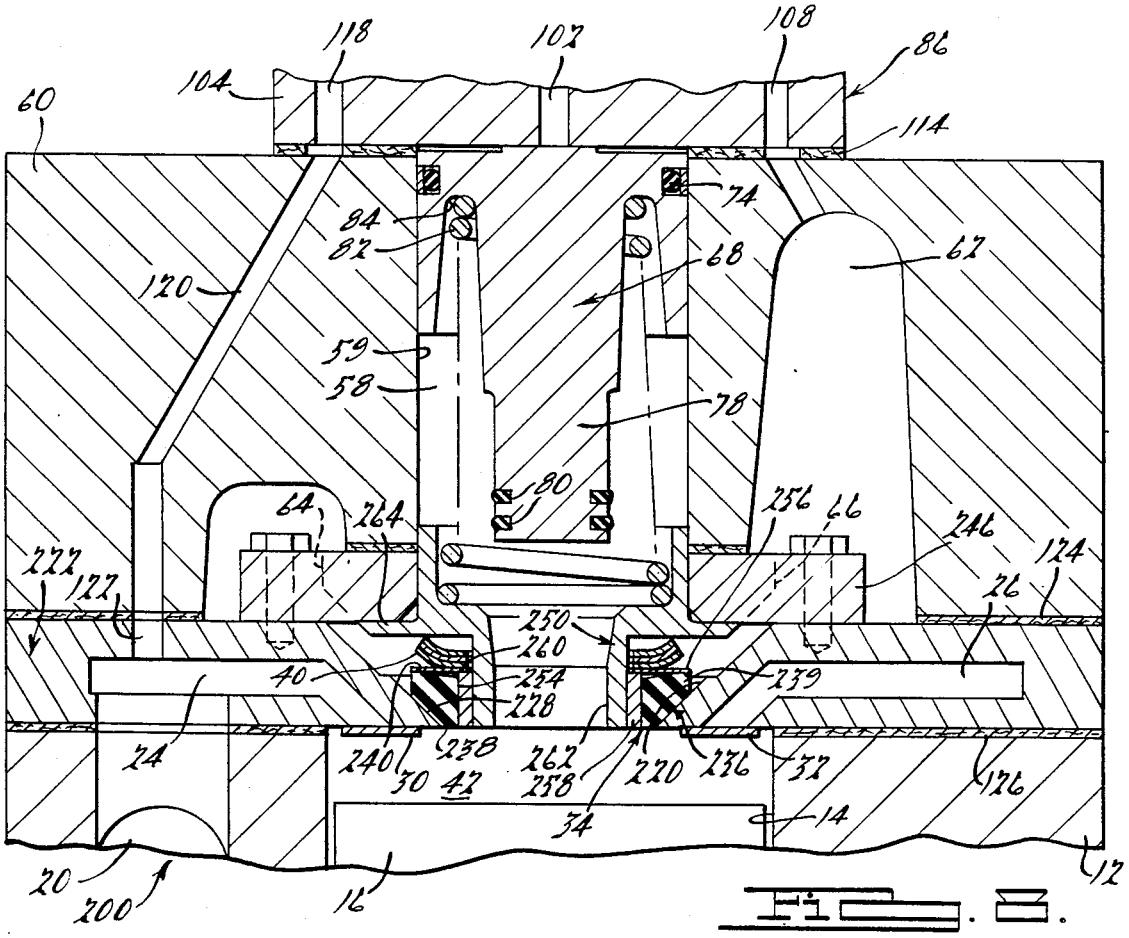
FIG. 8 is a partial cross-sectional view similar to that of FIG. 7, but illustrating the gas compressor in an unloaded condition.
Figure 9:
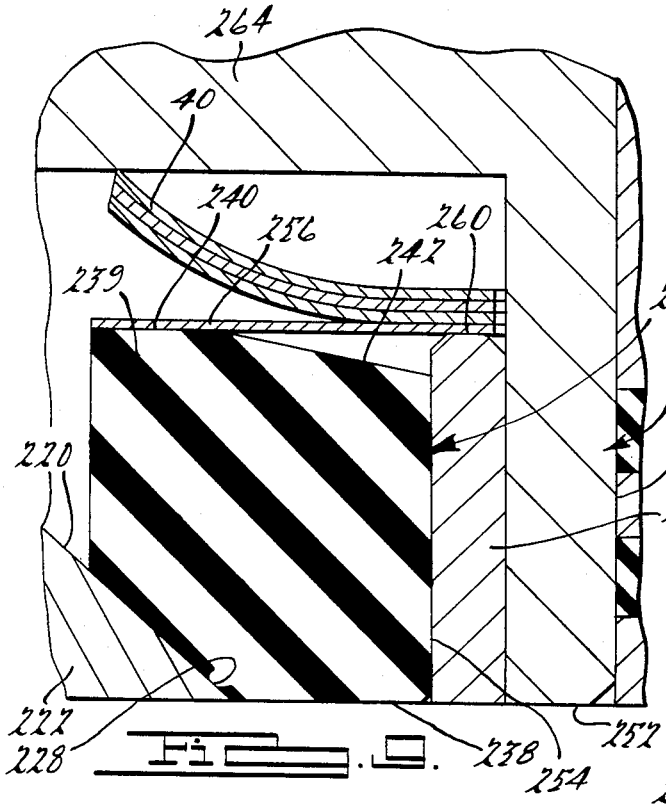
FIG. 9 is an enlarged detail view of the circled portion of FIG. 7 indicated at "9".

Referring to FIGS. 7 through 9, gas compressor 200 is generally similar to the gas compressor shown in FIGS. 1 through 6 except for the modifications to the discharge valve assembly discussed below. Therefore, elements shown in FIGS. 7 through 13 that are either identical or substantially similar to the corresponding elements shown in FIGS. 1 through 6 are indicated by like reference numerals.

In the gas compressor 200, valve member 236 is disposed in a discharge flow opening 220, which extends in a longitudinal direction through valve plate 222 and is defined in part by valve seat 228. Valve member 236 includes a laterally inner or central opening 254 and is slidably movable longitudinally on neck member 250 between an open position, in which valve member 236 is longitudinally spaced apart from valve seat 228, and a closed position sealingly engaging valve seat 228.

Neck member 250, which extends longitudinally within the laterally inner opening 254 of valve member 236, is fixed relative to valve plate 222 and head member 60 and has affixed thereto (as by a sealed press fit, for example) a sleeve 258 upon which valve member 236 slidably moves. Neck member 250 also includes neck opening 262 extending longitudinally therethrough for providing fluid communication between compression chamber 42 and clearance pocket 58 during compressor capacity modulation as described above in connection with FIGS. 1 through 6.

A generally flat, disc-shaped, resilient sealing member 256 is disposed around neck member 250 and extends generally laterally outwardly therefrom. Sealing member 256 is preferably formed of a thin resilient sheet material, such as spring steel for example, and sealingly engages both a laterally-extending sealing surface 240 on shoulder portion 239 of valve member 236 and a similar laterally-extending sealing surface 260 formed on sleeve 258 when valve member 236 is in its closed position. Preferably, sealing surface 240 on valve member 236 is laterally spaced outwardly away from inner opening 254, with a relieved or recessed portion 242 therebetween. Such recessed portion 242 (shown greatly exaggerated in depth in FIG. 9) provides clearance for resilient deflection of sealing member 256 during slidable movement of valve member 236 and for accommodating any slight difference in the height of sealing surfaces 240 and 260. It should be noted that although recessed portion 242 is illustrated as sloping from sealing surface 240 in a direction generally laterally inwardly and longitudinally toward valve seat 228, a stepped recessed portion may alternatively be provided.

Resilient sealing member 256 is biased into the above-described sealing engagement with the lateral sealing surfaces 240 and 260 of valve member 236 and neck member 250, respectively, by the gas pressure differential that exists across valve member 236 when valve member 236 is in its closed position. Such pressure differential results from the difference in the gas pressure between the discharge plenum 62 and compression chamber 42 during the suction down-stroke of piston 16. Resilient sealing member 256 is also resiliently biased into such sealing engagement by the spring crimps 40 which are compressed between flange portion 264 of neck member 250 and resilient sealing member 256. Spring crimps 40 also act through resilient sealing member 256 to resiliently bias valve member 236 into sealing engagement with valve seat 228, with the combined spring rate of spring crimps 40 and resilient sealing member 256 being preselected to allow valve member 236 to quickly spring open when the pressure in compression chamber 42 reaches a predetermined level during the up-stroke of piston 16.

In the embodiments of the gas compressor 200 shown in FIGS. 7 through 9, flange portion 264 of neck member 250 is supported by a bridge-like retainer member 246, which is fixedly secured to valve plate 222 in order to restrain neck member 250 from longitudinal movement away from valve plate 222. Because of the interconnection of retainer member 246 and flange portion 264 with valve plate 222, the resilient biasing force of spring crimps 40 exerts a reactive force on valve plate 222 acting through flange portion 264 and retainer member 246. Thus, valve member 236 and resilient sealing member 256 are resiliently biased in a longitudinal direction toward valve seat 228.

This embodiment is shown in its "loaded" condition in FIG. 7 and in its "unloaded" condition in FIG. 8.

Figure 10:
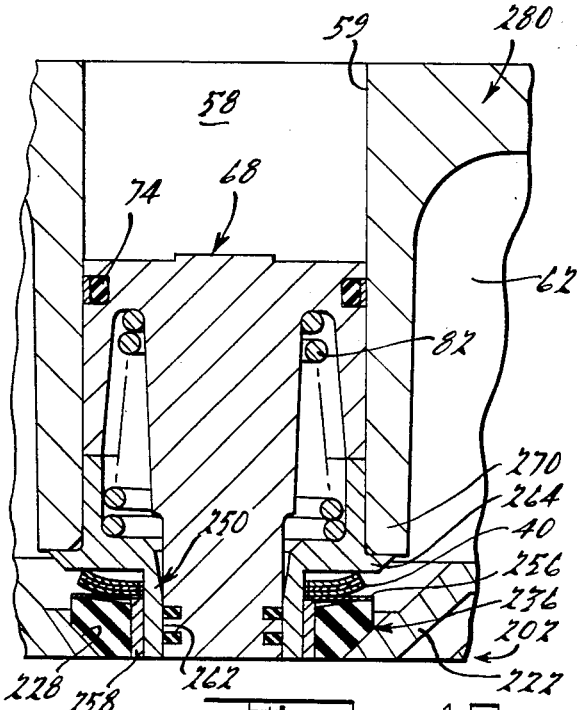
FIG. 10 is a partial cross-sectional view similar to that of FIG. 7, but illustrating an alternate construction of the invention.

In an alternate construction shown in FIG. 10, gas compressor 202 is generally similar to gas compressor 200 shown in FIGS. 7 through 9, except that flange portion 264 of neck member 250 is abuttingly engaged by a longitudinally-extending portion 270 of head member 280, which is generally similar to the previously-described head member 60 in other respects. Such abutting engagement of longitudinal portion 270 with flange portion 264 restrains neck member 250 from longitudinal movement away from valve plate 222. Furthermore, because head member 280 is secured to valve plate 222, and spring crimps 40 are compressed between flange portion 264 and sealing member 256, spring crimps 40 exert a reactive force on head member 280, which is in turn transferred to valve plate 222 as a result of head member 280 being interconnected with valve plate 222. In other respects gas compressor 202 and its valve assembly are substantially similar to gas compressor 200 shown in FIGS. 7 through 9. This arrangement is advantageous in that it is simpler (fewer parts) and thus less costly. On the other hand, it requires a more accurately machined head assembly in order to control tolerances of the valve.

Figure 11:
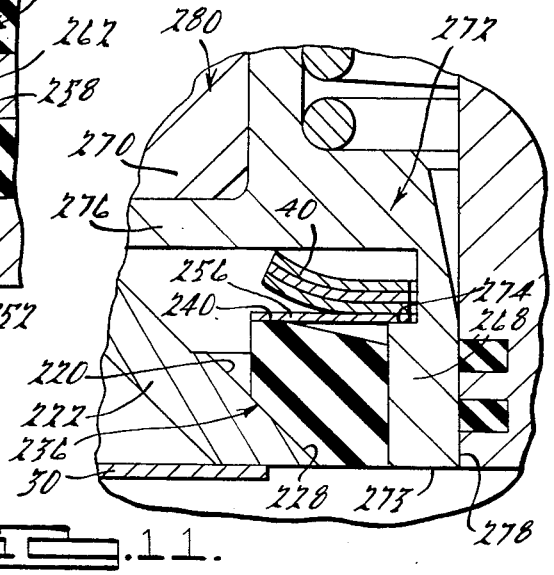
FIG. 11 is an enlarged cross-sectional view similar to that of FIG. 9, but illustrating still another embodiment of the present invention in which the neck member includes an integral shoulder portion thereon.

Although shoulder portion 258 comprises a separate sleeve member press fitted or otherwise fixedly secured along a portion of neck member 250 in FIGS. 7 through 10, an alternative arrangement can be provided as shown in FIG. 11. In FIG. 11 an integral shoulder portion 268 is integrally formed on neck member 272 in order to define sealing surface 274 thereon. Functionally, neck member 272, with its integral shoulder portion 268 and sealing surface 274, is identical to neck member 250 of FIGS. 7 through 10 and includes flange portion 276 corresponding to flange portion 264 of neck member 250. In other respects, the valve assembly shown in FIG. 11 is substantially the same in configuration and function as the valve assemblies shown in FIGS. 7 through 10. In this regard, it should be noted that either the separate sleeve-type shoulder portion 258 of neck member 250, or the integral shoulder portion 268 of neck member 272, can be employed with either gas compressor 200 (FIGS. 7 through 9) or gas compressor 202 (FIG. 10), as well as with any of the other embodiments described herein.

Figure 12:
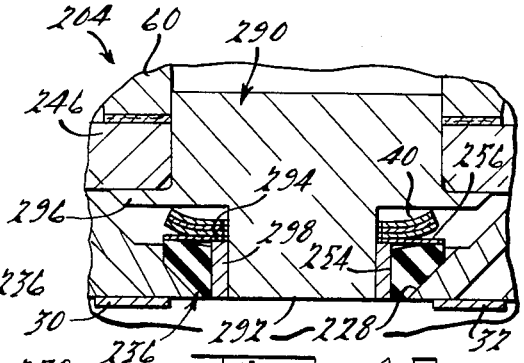
FIG. 12 is a partial cross-sectional view similar to that of FIG. 7, but illustrating the preferred valve assembly in a gas compressor that does not include the capacity modulation apparatus shown in FIGS. 1 through 11.
Figure 13:
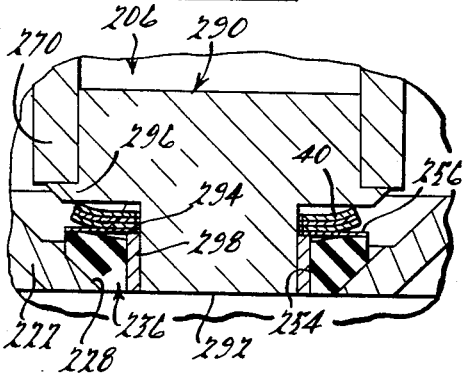
FIG. 13 is a partial cross-sectional view similar to that of FIG. 10, but illustrating the preferred valve assembly in an alternate gas compressor that does not include the capacity modulation apparatus shown in FIGS. 1 through 11.

FIGS. 12 and 13 illustrate further alternate embodiments of the present invention, wherein gas compressors 204 and 206 correspond generally to gas compressors 200 and 202, respectively, with the exception that no capacity modulation system is provided. Because of this difference, neck member 250 (or alternate neck member 272 with its integral shoulder portion) is replaced by a generally closed neck member 290. Neck member 290 includes a flush end portion 292, a sealing surface 294 and a flange portion 296, which respectively correspond with end portion 252, sealing surface 260, and flange portion 264 of neck member 250, as well as with end portion 273, sealing surface 274, and flange portion 276 of neck member 272. Shoulder portion 298, which forms sealing surface 294, can be either a separate sleeve member as discussed above in connection with neck member 250, or an integral shoulder portion 268 as in neck member 272 discussed above. However, since no capacity modulation system is provided in gas compressors 204 and 206, neck member 290 is generally solid or closed and does not have a longitudinal opening extending therethrough. In all other respects the function and relationship between valve member 236 and neck member 290 are substantially the same as that described above in connection with FIGS. 7 through 11.

The foregoing discussion discloses and describes exemplary embodiments of the present invention. One skilled in the art will readily recognize from such discussion that various changes, modifications and variations may be made therein without departing from the spirit and scope of the invention as described in the following claims.

We claim:

1. An improved valve assembly comprising:

means having an opening, the wall of which defines a valve seat;

a neck member fixedly disposed in said opening and having a central opening therethrough with a plunger slidably disposed therein;

a valve member slidably disposed on said neck member and being movable between a closed position in which it engages said seat and an open position in which it is spaced from said seat, said valve and neck members and said plunger being substantially flush with one another on the upstream side of said valve assembly when said valve member is in said closed position; and a seal member for preventing the flow of fluid between said valve member and said neck member when said valve member is in said closed position.

2. An improved valve assembly comprising;

means having an opening, the wall of which defines a valve seat;

a neck member fixedly disposed in said opening;

a valve member slidably disposed on said neck member and being movable between a closed position in which it engages said seat and an open position in which it is spaced from said seat, said valve and neck members each having an annular sealing surface with said sealing surface on said valve member being disposed adjacent the outer periphery thereof; and a seal member for preventing the flow of fluid between said valve member and said neck member when said valve member is in said closed position, said seal member sealingly engaging each of said sealing surfaces when said valve member is in said closed position.

3. The assembly of claim 2, wherein said valve member is relieved between said sealing surface thereon and the inner periphery thereof.

4. An improved valve assembly comprising:

a valve plate having an opening, the wall of which defines a valve seat;

a neck member fixedly disposed in said opening;

a valve member slidably disposed on said neck member and being movable between a closed position in which it engages said seat and an open position in which it is spaced from said seat, said valve and neck members each having an annular sealing surface;

a sleeve affixed to said neck member, said sealing surface on said neck member being defined by said sleeve;

an annular resilient seal member for preventing the flow of fluid between said valve member and said neck member when said valve member is in said closed position, said seal member sealingly engaging each of said sealing surfaces when said valve is in said closed position;

a retainer member fixedly connected to said valve plate; and spring means disposed generally between said retainer member and said valve member for resiliently biasing said valve member toward said closed position.

5. The assembly of claim 4, wherein said neck member includes a portion thereof being engaged and restrained by said retainer member from movement in a direction away from said valve member.

6. The assembly of claim 5, wherein said spring means is compressed between said portion of said neck member and said valve member.

7. An improved valve assembly comprising:

a valve plate having an opening, the wall of which defines a valve seat;

a neck member fixedly disposed in said opening and having a central opening therethrough with a plunger slidably disposed therein;

a valve member slidably disposed on said neck member and being movable between a closed position in which it engages said seat and an open position in which it is spaced from said seat, said valve and neck members and said plunger being substantially flush with one another on the upstream side of said valve assembly when said valve member is in said closed position;

a seal member for preventing the flow of fluid between said valve member and said neck member when said valve member is in said closed position;

a retainer member fixedly connected to said valve plate; and spring means disposed generally between said retainer member and said valve member for resiliently biasing said valve member toward said closed position.

8. The assembly of claim 7, wherein said neck member includes a portion thereof being engaged and restrained by said retainer member from movement in a direction away from said valve member.

9. The assembly of claim 8, wherein said spring means is compressed between said portion of said neck member and said valve member.

10. An improved valve assembly for a gas compressor, comprising:

a means defining an opening, the wall of which defines a valve seat;

a neck member fixedly disposed in said opening;

a valve member slidably disposed on said neck member and being movable between a closed position in which it engages said seat and an open position in which it is spaced from said seat, said valve and neck members each having an annular sealing surface;

a sleeve affixed to said neck member, said sealing surface on said neck member being defined by said sleeve;

an annular resilient seal member for preventing the flow of fluid between said valve member and said neck member when said valve member is in said closed position, said seal member engaging each of said sealing surfaces when said valve member is in said closed position;

a compressor head assembly fixedly disposed with respect to said valve seat, with said valve member being disposed between said valve seat and said head assembly; and spring means disposed generally between said head member and said valve member for resiliently biasing said valve member toward said closed position.

11. The assembly of claim 10, wherein said neck member includes a portion thereof being engaged and restrained by said head assembly from movement in a direction away from said valve member.

12. The assembly of claim 11, wherein said spring means is compressed between said portion of said neck member and said valve member.

13. An improved valve assembly for a gas compressor, comprising:

means defining an opening, the wall of which defines a valve seat;

a neck member fixedly disposed in said opening and having a central opening therethrough with a plunger slidably disposed therein;

a valve member slidably disposed on said neck member and being movable between a closed position in which it engages said seat and an open position in which it is spaced from said seat, said valve and neck members and said plunger being substantially flush with one another on the upstream side of said valve assembly when said valve member is in said closed position;

a seal member for preventing the flow of fluid between said valve member and said neck member when said valve member is in said closed position;

a compressor head assembly fixedly disposed with respect to said valve seat, with said valve member being disposed between said valve seat and said head assembly; and spring means disposed generally between said head member and said valve member for resiliently biasing said valve member toward said closed position.

14. The assembly of claim 13, wherein said neck member includes a portion thereof being engaged and restrained by said head assembly from movement in a direction away from said valve member.

15. The assembly of claim 14, wherein said spring means is compressed between said portion of said neck member and said valve member.

16. An improved valve assembly for a gas compressor,comprising:

means defining an opening, the wall of which defines a valve seat;

a neck member fixedly disposed in said opening;

a valve member slidably disposed on said neck member and being movable between a closed position in which it engages said seat and an open position in which it is spaced from said seat, said valve and neck members each having an annular sealing surface, said sealing surface on said valve member being disposed adjacent the outer periphery thereof;

an annular resilient seal member for preventing the flow of fluid between said valve member and said neck member when said valve member is in said closed position, said seal member engaging each of said sealing surfaces when said valve member is in said closed postion;

a compressor head assembly fixedly disposed with respect to said valve seat, with said valve member being disposed between said valve seat and said heat assembly; and spring means disposed generally between said head member and said valve member for resiliently biasing said valve member toward said closed position.

17. The assembly of claim 16, wherein said valve member is relieved between said sealing surface thereon and the inner periphery thereof.

18. The assembly of claim 16, wherein said neck member includes a portion thereof being engaged and restrained by said head assembly from movement in a direction away from said valve member.

19. The assembly of claim 18, wherein said spring means is compressed between said portion of said neck member and said valve member.

20. An improved valve assembly comprising:

a valve plate having an opening, the wall of which defines a valve seat;

a neck member fixedly disposed in said opening;

a valve member slidably disposed on said neck member and being movable between a closed position in which it engages said seat and an open position in which it is spaced from said seat, said valve and neck member each having an annular sealing surface;

a seal member for preventing the flow of fluid between said valve member and said neck member when said valve member is in said closed position, said seal member sealingly engaging each of said sealing surfaces when said valve is in said closed position, said sealing surface on said valve being disposed adjacent the outer periphery thereof;

a retainer member fixedly connected to said valve plate; and spring means disposed generally between said retained member and said valve member for resiliently biasing said valve member toward said closed position.

21. The assembly of claim 20, wherein said valve member is relieved between said sealing surface thereof and the inner periphery thereof.

22. The assembly of claim 20, wherein said seal member is disposed between said spring means and said valve member.

23. The assembly of claim 20, wherein said neck member includes a portion thereof being engaged and restrained by said retainer member from movement in a direction away from said valve member.

24. The assembly of claim 23, wherein said spring means is compressed between said portion of said neck member and said valve member.

25. An improved valve assembly comprising:

means having an opening, the wall of which defines a valve seat;

a neck member fixedly disposed in said opening;

a valve member slidably disposed on said neck member and being movable between a closed position in which it engages said seat and an open position in which it is spaced from said seat, said valve and neck members each having an annular sealing surface;

an annular resilient seal member for preventing the flow of fluid between said valve member and said neck member when said valve member is in said closed position, said seal member sealingly engaging each of said sealing surfaces when said valve member is in said closed position; and a sleeve affixed to said neck member, said sealing surface on said neck member being defined by said sleeve.

26. The assembly of claim 25, wherein said seal member is formed of an elastomeric material and is disposed between said valve and neck members.

27. The assembly of claim 25, wherein said sealing surface on said neck member is integral therewith.

28. The assembly of claim 25, wherein said seal member is formed from sheet metal.

29. The assembly of claim 25, wherein said seal member is normally flat.

30. The assembly of claim 25, wherein said sealing surfaces are generally flat and disposed in substantially the same plane when said valve member is in said closed position.

31. The assembly of claim 25, further comprising a spring means biasing said valve member to said closed position.

32. The assembly of claim 31, wherein said seal member is disposed between said spring means and said valve member.

33. The assembly of claim 25, wherein said valve seat is conical in configuration.

34. The assembly of claim 25, wherein said valve member is formed of an elastomeric material.

35. The assembly of claim 25, wherein said neck member has a central opening therethrough having a plunger slidably disposed therein.

36. The assembly of claim 25, wherein said valve member and neck member are substantially flush with one another on the upstream side of said valve assembly when said valve member is in said closed position.

37. An improved valve assembly comprising:

a valve plate having an opening, the wall of which defines a valve seat within said opening;

a neck member fixedly disposed at least in part within said opening;

a valve member slidably disposed on said neck member and being movable between a closed position in which it engages said seat within said opening and an open position in which it is spaced from said seat, said valve and neck members each having an annular sealing surface;

an annular resilient seal member for preventing the flow of fluid between said valve member and said neck member when said valve member is in said closed position, said seal member sealingly engaging each of said sealing surfaces when said valve member is in said closed position;

a retainer member fixedly connected to said valve plate; and spring means disposed generally between said retainer member and said valve member for resiliently biasing said valve member toward said closed position.

38. The assembly of claim 37, wherein said seal member is formed of an elastomeric material and is disposed between said valve and neck members.

39. The assembly of claim 37, wherein said sealing surface on said neck member is integral therewith.

40. The assembly of claim 37, wherein said seal member is formed from sheet metal.

41. The assembly of claim 37, wherein said seal member is normally flat.

42. The assembly of claim 37, wherein said sealing surfaces are generally flat and disposed in substantially the same plane when said valve member is in said closed position.

43. The assembly of claim 37, wherein said valve seat is conical in configuration.

44. The assembly of claim 37, wherein said valve member is formed of an elastomeric material.

45. The assembly of claim 37, wherein said neck member has a central opening therethrough having a plunger slidably disposed therein.

46. The assembly of claim 37, wherein said valve member and neck member are substantially flush with one another on the upstream side of said valve assembly when said valve member is in said closed position.

47. The assembly of claim 37, wherein said neck member includes a portion thereof being engaged and restrained by said retainer member from movement in a direction away from said valve plate, said spring means being compressed between said portion of said neck member and said valve member.

48. The assembly of claim 47, wherein said seal member is disposed between said spring means and said valve member.

49. The assembly of claim 37, wherein said neck member includes a portion thereof being engaged and restrained by said retainer member from movement in a direction away from said valve member.

50. The assembly of claim 49, wherein said spring means is compressed between said portion of said neck member and said valve member.

51. An improved valve assembly for a gas compressor, comprising:

a means defining an opening, the wall of which defines a valve seat within said opening;

a neck member fixedly disposed at least in part within said opening;

a valve member slidably disposed on said neck member and being movable between a closed position in which it engages said seat within said opening and an open position in which it is spaced from said seat, said valve and neck members each having an annular sealing surface;

an annular resilient seal member for preventing the flow of fluid between said valve member and said neck member when said valve member is in said closed position, said seal member sealingly engaging each of said sealing surfaces when said valve member is in said closed position;

a compressor head assembly fixedly disposed with respect to said valve seat, with said valve member being disposed between said valve seat and said head assembly; and spring means disposed generally between said head member and said valve member for resiliently biasing said valve member toward said closed position.

52. The assembly of claim 51, wherein said seal member is formed of an elastomeric material and is disposed between said valve and neck members.

53. The assembly of claim 51, wherein said sealing surface on said neck member is integral therewith.

54. The assembly of claim 4, wherein said seal member is formed from sheet metal.

55. The assembly of claim 52, wherein said seal member is normally flat.

56. The assembly of claim 51, wherein said sealing surfaces are generally flat and disposed in substantially the same plane when said valve member is in said closed position.

57. The assembly of claim 51, wherein said seal member is disposed between said spring means and said valve member.

58. The assembly of claim 52, wherein said valve seat is conical in configuration.

59. The assembly of claim 52, wherein said valve member is formed of an elastomeric material.

60. The assembly of claim 52, wherein said neck member has a central opening therethrough having a plunger slidably disposed therein.

61. The assembly of claim 51, wherein said valve member and neck member are substantially flush with one another on the upstream side of said valve assembly when said valve member is in said closed position.

62. The assembly of claim 52, wherein said neck member includes a portion thereof being engaged and restrained by said head assembly from movement in a direction away from said valve member, said spring means being compressed between said portion of said neck member and said valve member.

63. The assembly of claim 62, wherein said member is disposed between said spring means and said valve member.

64. The assembly of claim 51, wherein said neck member includes a portion thereof being engaged and restrained by said head assembly from movement in a direction away from said valve member.

* * * * *

UNITED STATES PATENT AND TRADEMARK OFFICE

CERTIFICATE OF CORRECTION

PATENT NO. : 4,685,489

DATED : August 11, 1987

INVENTOR(S) : Kyung W. Yun, Othel L. Jones, Gerald M. Long & John P. Elson

It is certified that error appears in the above-identified patent and that said Letters Patent is hereby corrected as shown below:

Column 1, line 44, "complimentary" should be -- complementary --.

Column 2, line 13, "in to" should be -- into --.

Column 2, line 14, "systems" should be -- system --.

Column 3, line 68, "i.g." should be -- i.e. --.

Column 7, line 17, "heat" should be -- head --.

Column 9, line 45, "height" should be -- heights --.

Column 14, line 10, "postion" should be -- position --.

Column 14, line 14, "heat" should be -- head --.

Column 14, line 53, "thereof" should be -- thereon --.

Column 17, line 3, "4" should be -- 51 --.

Column 17, line 5, "52" should be -- 51 --.

Column 17, line 17, "52" should be -- 51 --.

Column 17, line 19, "52" should be -- 51 --.

Column 18, line 1, "52" should be -- 51 --.

Column 18, line 8, "52" should be -- 51 --.

Column 18, line 14, after "said" insert -- seal --.

UNITED STATES PATENT AND TRADEMARK OFFICE

CERTIFICATE OF CORRECTION

PATENT NO. : 4,685,489

DATED : August 11, 1987

INVENTOR(S) : Kyung W. Yun, Othel L. Jones, Gerald M. Long & John P. Elson

It is certified that error appears in the above-identified patent and that said Letters Patent is hereby corrected as shown below:

Column 15, lines 16-18, Claim 26, delete the entire claim.

Column 15, lines 19-20, Claim 27, delete the entire claim.

Signed and Sealed this

Fifth Day of April, 1994

*Attest:*

*Attesting Officer*

BRUCE LEHMAN

*Commissioner of Patents and Trademarks*